United States Patent [19]

Watts, Jr.

[11] 4,136,777

[45] Jan. 30, 1979

[54] PACKAGE WITH TEAR ELEMENT

[75] Inventor: Ridley Watts, Jr., Cleveland, Ohio

[73] Assignee: American Packaging Corporation, Hudson, Ohio

[21] Appl. No.: 289,870

[22] Filed: Sep. 18, 1972

Related U.S. Application Data

[63] Continuation of Ser. No. 52,782, Jul. 6, 1970, abandoned, which is a continuation-in-part of Ser. No. 17,575, Mar. 9, 1970, abandoned.

[51] Int. Cl.[2] ..... B65D 17/20; B65D 65/34; B65D 77/36

[52] U.S. Cl. ..... 206/469; 206/471; 206/616

[58] Field of Search ..... 206/56 AA, 80 A, 461, 206/469, 498; 229/51 S, 66, 86

[56] References Cited

U.S. PATENT DOCUMENTS

| | | | |
|---|---|---|---|
| 1,541,167 | 6/1925 | Mulvey | 206/DIG. 4 UX |
| 2,030,610 | 2/1936 | Randall | 57/152 |
| 2,584,336 | 2/1952 | Eisenhardt | 229/51 S |
| 3,153,505 | 10/1964 | Bessett | 206/80 A UX |
| 3,352,480 | 11/1967 | Forman | 229/51 S |
| 3,385,424 | 5/1968 | Thompson et al. | 206/80 AU X |
| 3,386,571 | 6/1968 | Kraut | 206/80 A |
| 3,477,194 | 11/1969 | Corrsin | 206/80 A X |
| 3,565,329 | 2/1971 | Wagner, Jr. et al. | 229/66 |

FOREIGN PATENT DOCUMENTS

| | | | |
|---|---|---|---|
| 595512 | 12/1947 | United Kingdom | 206/56 AA |

OTHER PUBLICATIONS

Roff; Fibers, Plastics and Rubbers; Butterworths Scientific Publications, London, 1956, pp. 72, 80.

*Primary Examiner*—William Price
*Assistant Examiner*—Joseph Man- Fu Moy
*Attorney, Agent, or Firm*—Watts, Hoffmann, Fisher & Heinke Co.

[57] ABSTRACT

A package with a stretchable tear element for opening the package. In a preferred embodiment the tear element extends over a packaged article and beneath a covering plastic film formed over the article to secure the article to a supporting panel. The tear element is capable of stretching sufficiently, when the plastic film is drawn down in a softened condition over the product to form the package, so that the film can conform itself and the tear element substantially to the shape of the product and any tendency of the film to form a tent across an initial span of the tear element is minimized. The tear element further stretches, in part within the package, when one end is pulled back across the film so that a portion of the element moves past the film at the exit point, producing a slicing or sawing action, while at the same time it remains essentially anchored at the opposite end. The panel is preferably foldable to form a box. A thermoplastic adhesive coating is on the panel for adhering the plastic film and incorporates a colorant that shields the panel from heat and enhances the rate at which the adhesive softens in response to infrared radiation.

6 Claims, 6 Drawing Figures

FIG. 1
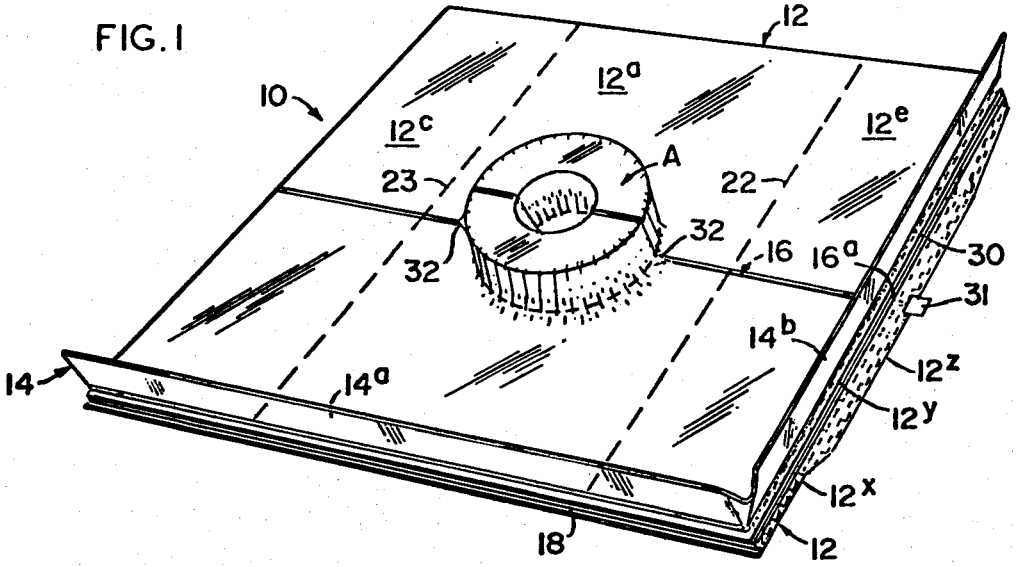
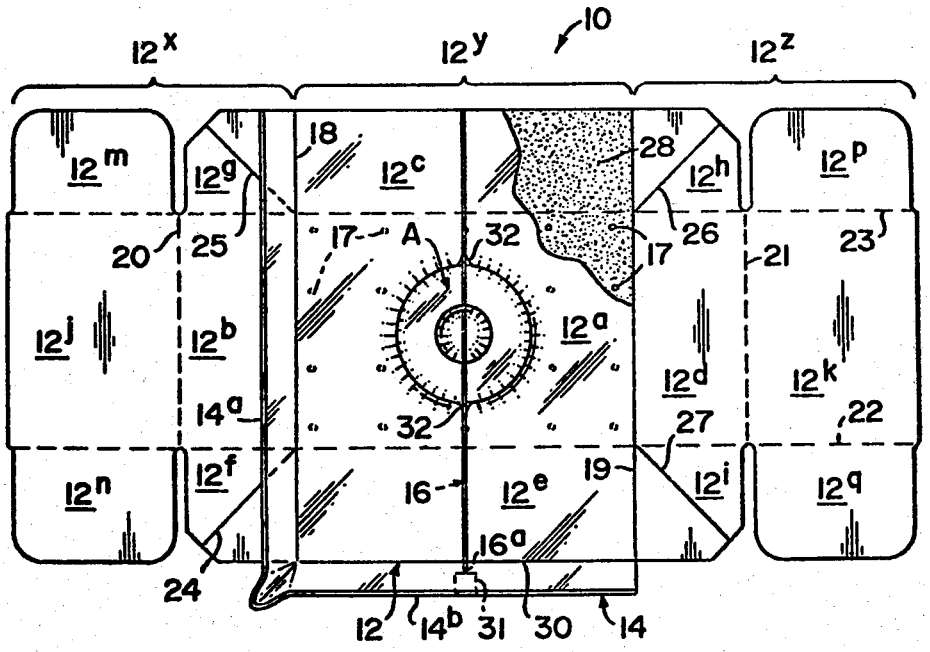
FIG. 2

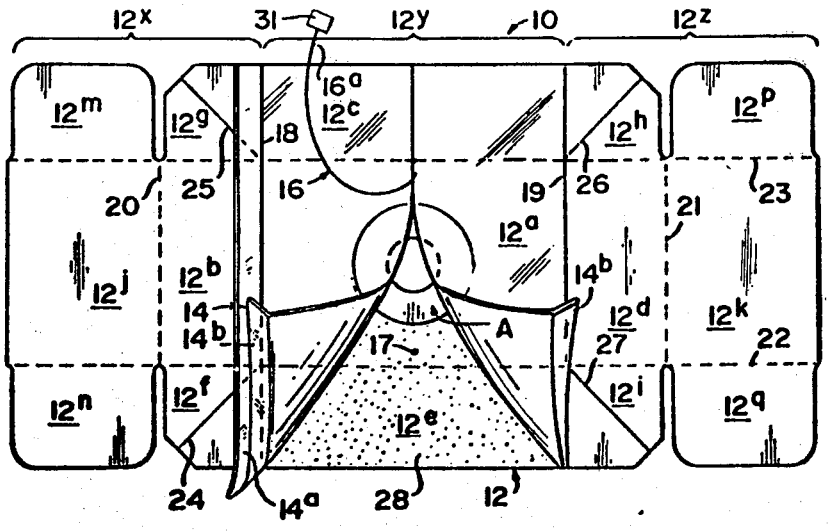
FIG. 3
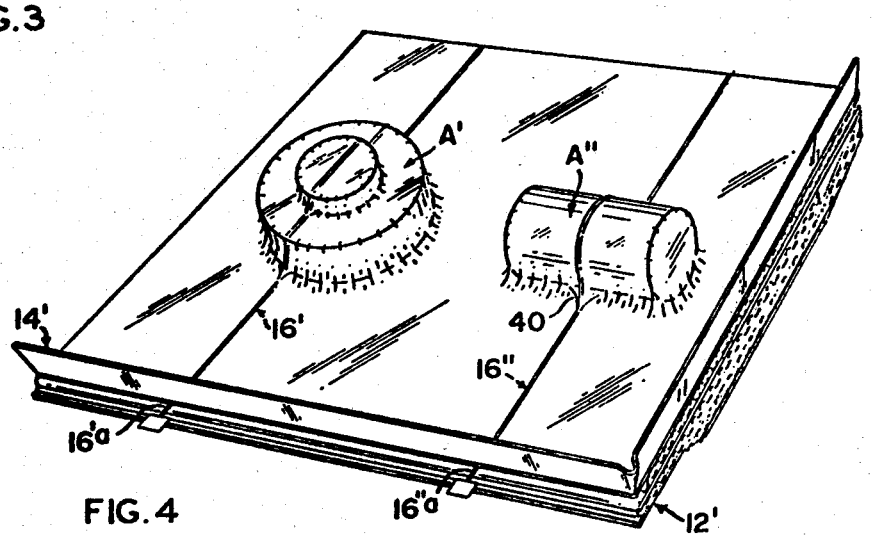
FIG. 4
FIG. 5
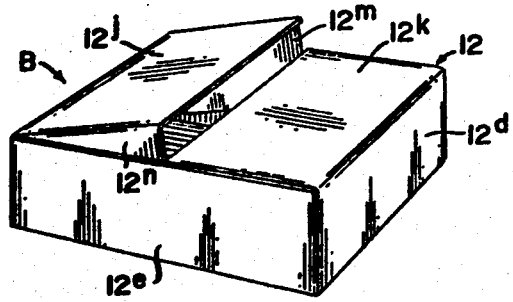
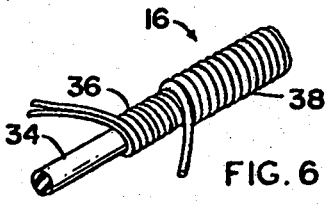
FIG. 6

PACKAGE WITH TEAR ELEMENT

Cross Reference to Related Application

This application is a continuation of application Ser. No. 52,782, filed July 6, 1970 now abandoned, which in turn is a continuation-in-part of application Ser. No. 17,575, filed March 9, 1970 and entitled "Package With Tear Element" (now abandoned).

BACKGROUND OF THE INVENTION

1. Field of the Invention

This invention relates to an improved package, especially a so-called skin-type package.

2. Prior Art

Many different package structures have been provided with a variety of convenient opening features. For example, tear strings have been used with mailing tubes and other tubular containers and cartons for a great many years and tear strips on gum wrappers and cigarette packages are well known. With the more recent advent of packages utilizing plastic film, the effectiveness of tear strings has been impaired because of the difficulty with which some of the plastic films are torn. At the same time, the high tear strength of these films increases the need for an opening device. In addition, such films are typically tightly wrapped about, drawn over or shrunk about a product, making it difficult to grasp the film to tear it open.

Tear strips or the like have been proposed for certain types of packages made of plastic film, such as plastic bags and certain shrink-type packages, but have heretofore not been satisfactory for skin-type packages of the type where a product is supported on a card or panel by a relatively strong plastic film that is securely adhered thereto. This is understandable when it is realized that, for the tear string to be conveniently included and to function most effectively with such a package, it must be applied across the article itself, along with the film, so that manipulation of the string during placement is minimized and the string is positioned to sever the film in a location that readily facilitates direct removal of the article. On the other hand, such a location proves to be unsatisfactory with typical tear strings. This is because the tear string does not initially follow the contour of the article, but is merely draped across the article and panel, there is normally insufficient slack in the string to promote conformance to the article, and the film is softened by heat to conform to the product. As a result, the film will be initially suspended by the string, like a tent, away from side portions of the article and will then form around the string and be drawn together beneath the string span. When this happens, the string will not open the package satisfactorily, because the film is sealed beneath the string at the sides of the article. A further problem experienced by the applicant in initial attempts to develop a tear string for a skin-type package is that, except for the thinnest films, it is extremely difficult to tear plastic film with a string. With the heavier films, such as 10 mil (0.010 inch thick) polyethylene, it is extremely difficult and some times impossible to begin the tear by gripping a string with the fingers and pulling. This is especially true if the edge of the film is folded back upon itself to form a double thickness, as may be necessary in order to expose one end of the tear string.

In the forming of skin type packages, both the film that covers the product and a thermoplastic adhesive on the panel are heated to facilitate conformance of the film to the product being packaged and adherence of the film to the panel. It has generally been difficult to soften the film and also the adhesive coating on the panel without overheating either the panel or the film or both in the process.

SUMMARY OF THE INVENTION

The present invention is directed to improved packages incorporating one or more of a number of novel and advantageous features, and especially to package with an improved tear element and an improved adhesive. Packages embodying this invention overcome the above-mentioned and other shortcomings of known packages, and especially overcome the difficulties in opening packages formed of tough plastic film.

With respect to skin packages of the type in which an article is secured by a plastic film to a supporting panel, it has been found that a tear element can be satisfactorily incorporated if the tear element can be easily stretched by the plastic film as the film is drawn down over the product and against the supporting panel. This desirable ability has been achieved with the present invention by using a tear element that readily stretches under the forces applied by even a softened film, and thereby eliminates the substantial bridging or tenting of the film that would otherwise occur with a conventional tear string. Typically, a very slight bridging may still occur to form a small fillet or rib in the area of the tear element near the juncture of the panel and product being packaged. This small fillet is not objectionable in appearance and will not interfere with the opening of the package as long as the fillet is not so large that the film will draw together and seal beneath the bridged portion of the string over a significant area. The fillet or rib is actually advantageous with certain packaged articles, such as cylindrical articles that rest on their side against a supporting panel. With such cylindrical articles, when the tear element extends transversely across the cylindrical articles, the film is prevented by the tear element from being drawn beneath the cylindrical surfaces to the extent it otherwise would be in the absence of the tear element. in such instances, the fillet functions as a stiffening rib in the film and the cylindrical product is then less likely to wobble (i.e., tend to roll or pivot about the line of contact with the panel) as it would with the film drawn closely together from opposite sides beneath the cylindrical surface.

The ability of the film to stretch the tear element into close conformance with the packaged article can be improved in a skin package if adhesion of the sheet or film to the supporting panel can be obtained at a lower temperature of the sheet than heretofore found satisfactory. It will be appreciated by those familiar with this art that the film used in skin packaging is heated to soften the film so that it will form about the product being packaged and will become slightly tacky to aid it in sticking to the panel or base board that supports the product. It is customary to provide a thermoplastic adhesive coating on the panel, as well, to help adhere the film. In the usual process, the film is heated from above by radiant heat and convection while it is positioned above the base board. The base board is heated simultaneously with the film, but only by the radiant heat, to soften and make tacky the thermoplastic surface coating. Because the film and the coating are normally substantially transparent to infrared radiation, the heating of both is inefficient and in most cases the surface coating on the panel is actually heated through conduction from heat absorbed by the underlying panel, which more readily absorbs the radiant energy. This often results in an overheating of the panel, which drives out moisture and distorts the shape. The heating time required depends not only on the time required to soften the film, which is closer to the radiant source and aided by convection, but also on the time required to soften the less efficiently heated coating on the panel. Apart from the problem of overheating of the panel, care must be taken not to overheat and degrade or weaken the film in applying sufficient heat to soften the panel coating. In accordance with the present invention, a thermoplastic surface coating is provided on a penel for a skin package, that includes an agent that absorbs a broad range of infrared radiation. This produces a double benefit, in that (a) the surface coating acts as a screen or shield to protect the panel from the radiated heat and thereby prevents the panel from overheating and distorting, and (b) the absorption of radiation causes the surface coating to become adhesive faster than heretofore when subjected to the same heat source so that the film can be subjected to less heat without sacrificing adhesion, which depends primarily upon the softening of the thermoplastic adhesive coating on the panel. Such a reduction in the film heating preserves sufficient strength in the film during the forming operation so that it is better able to force the tear element to stretch into the general conformance of the product being packaged, thereby reducing the tendency of the tear element to suspend the film above the panel.

Unexpectedly, the stretchable tear element has the important further advantage of very substantially reducing the force needed to pull the tear element through the film. When the tear element is pulled by an extending end, it stretches, moving longitudinally within the package relative to the film. This movement, which occurs predominantly adjacent the location where the tear element exits from beneath the film, creates a sawing or slicing action on the film at the point at which the tear element exits. That is, the tear element moves in the area just in advance of where it escapes from the film as if it is being pulled out from beneath the film, yet remains anchored on the opposite side of the article from the side on which it is being pulled. As it stretches, to perhaps twice its original length or more, a very substantial length of the element is pulled past the exit point (which continually changes as the film is severed) on the film and very readily cuts its way through even the thickest film with the application of a relatively small pulling force. Advantageously, the stretch element is provided with a rough surface so that it saws or abrades its way through the film.

It will be appreciated that the ability of a stretchable tear element to conform to the contour of the product being packaged and to stretch and thereby tear or cut through the film with relatively little force is advantageous for other packages, e.g., shrink packages, as well as skin packages. A further advantage of the stretchable tear element is that the stretching prevents the element from being broken in the event it is jerked during the opening process. In addition, the stretching of the element reduces the diameter of the element so that it encounters less resistance as it severs its way through the covering film.

It will be appreciated from the above that a principal object of this invention is to provide an improved skin package having a tear element.

Another object of this invention is to provide a stretchable tear element in a package, which tear element conforms to the contour of an article under the application of a relatively low force or weight, such as that applied by a heated plastic sheet or film as it is formed over the product in a typical skin packaging operation.

It is another object to provide a package with a stretchable tear element that stretches within a package so as to move past an outer covering overlying the tear element and to tear or sever the overlying covering with a slicing or sawing action that materially reduces the pulling force required to sever the covering.

It is a further object to provide thermoplastic adhesive on a panel or base board used in skin packaging with an agent within the adhesive that effectively absorbs a broad range of infrared radiation, to shield the panel from radiant heat during formation of the package and to increase the rate at which the adhesive softens under the application of radiant heat, and concomitantly to diminish the extent to which the plastic film must be heated to accomplish satisfactory adhesion to the panel or base board of a skin package. This makes possible a related object of shortening the cycle time required in skin packaging and increasing the ability of the heated film or sheet of plastic to stretch a tear element of a skin package into conformance with the contour of a packaged article.

It is a further object of this invention to provide in conjunction with one or more other features, a supporting panel that is precut and scored to facilitate skin packaging and subsequent folding into a shipping box that encloses a skin packaged article.

These and other objects, features and advantages of this invention will become better understood from the following detailed description, when considered in connection with the accompanying drawings.

BRIEF DESCRIPTION OF THE DRAWINGS

FIG. 1 is a perspective view of a skin package embodying the present invention and utilizing a base board formed of a plurality of sections and foldable into a box for further enclosing the skin packaged article;

FIG. 2 is a top plan view of the skin package of FIG. 1, with all panels of the base member extended;

FIG. 3 is a top plan view of the skin package of FIG. 2 after the covering plastic film has been partially severed by a tear element;

FIG. 4 is a perspective view similar to FIG. 1, illustrating a package embodying the present invention for enclosing two articles, each with a separate tear element;

FIG. 5 is a perspective view of the package of FIGS. 1 and 2, with the base board or panel folded into a box about the packaged article; and FIG. 6 is a partial detailed perspective view of a preferred embodiment of the tear element.

DESCRIPTION OF PREFERRED EMBODIMENTS

A package embodying the present invention is indicated generally at 10 in FIGS. 1 and 2 and consists basically of a supporting panel 12, a supported article A, a plastic film or sheet 14 to cover the article A and adhere it to the supporting panel 12, and a tear element 16 for severing the film 14 to facilitate removal of the article A. Briefly the package is made by placing the article A on the panel 12, which in turn is supported on a vacuum table. The plastic film 14 and the tear element 16 are pulled from a roll and a spool, respectively, preferably simultaneously, and clamped across a horizontal, vertically movable, frame positioned above the panel 12. The film and panel are then heated, typically by a radiant heater above the film. The film and tear element are then lowered onto the article A and panel 12, with the tear element extending over the product and across the panel. A vacuum is drawn through the panel to form the film over the article and to seal the film to the upper surface of the panel. Apparatus of the general type used for forming packages of this type is disclosed in the copending application of Ridley Watts, Jr. et al, Ser. No. 668,372, filed Sept. 18, 1967, (now U.S. Pat. No. 3,501,886) entitled Film Packaging Machine And Method and assigned to the assignee of this application.

The supporting panel 12 is relatively stiff and permeable or porous. In a preferred embodiment, it is formed of corrugated cardboard, as shown in FIG. 1, with a plurality of holes 17 extending through the panel in a central portion that underlies the film, to facilitate drawing a vacuum through the panel. In the embodiment shown, the supporting panel 12 is cut to the shape shown in FIG. 2 so that it can be folded to form a box, subsequent to the skin packaging of the article A. To facilitate this, transverse partial cuts 18 and 19, transverse fold lines 20 and 21, longitudinal fold lines 22 and 23 and diagonal partial cuts 24, 25, 26 and 27 are formed to define in the panel 12: a base-forming panel portion 12*a;* side-forming panel portions 12*b, c, d, e;* corner tuck-portions 12*f, g, h, i;* cover portions 12*j, k;* and cover flap portions 12*m, n* associated with portion 12*j,* and 12*p, q* associated with portion 12*k.* The entire support panel 12 is divided into three sections 12*x,* 12*y,* 12*z* along the transverse partial cut lines 18, 19. Each end section 12*x* and 12*z* is folded under the central section 12*y* of the panel, which is the largest section, as illustrated in FIG. 1. With the end sections folded under the central section as shown in FIG. 1, the supporting panel 12 functions essentially the same as the typical single section panel used for skin packaging, insofar as the forming of a skin package is concerned. After a skin package as shown in FIG. 1 is formed, the end sections of the panel are folded out and the panel is folded into a box B of the shape shown in FIG. 5, in which the panel portions 12*b-e* form the sides of the box, the panel portions 12*f-i* are folded along cut lines 24–27 and tucked inwardly at the corners between the side panel portions, the cover flaps 12*m, n* and 12*p, q* are tucked inside the side forming portions 12*b-e* and the cover portions 12*j, k* cover the article A and cover the container.

The central panel section 12*y* is coated with a thermoplastic adhesive 28, which assures that the film 14 adheres securely to the upper surface of the panel. A preferred coating is an aqueous resin dispersion sold under the trademark SURLYN D by E. I. du Pont de Nemours & Company. The coating is applied on the selected central section 12*g,* as with a roller-type printing plate or in some other suitable manner such as by spraying. A substance is added to the resin dispersion that has the characteristic of absorbing infrared radiation over a wide range of wave lengths. A preferred substance is a coloring agent, such as a food colorant in a water vehicle. A particularly suitable coloring agent is a blue dye sold by E. I. du Pont de Nemours & Company under the trademark MONASTRAL Blue B, Code No. BW-372-P, which is an aqueous pigment dispersion. This dispersion is added to the adhesive in the amount of one percent by volume. By virtue of the colorant, the adhesive visibly delineates the area to which the plastic film is to be adhered and provides a guide for locating the score lines 18, 19. When this adhesive is subjected to infrared radiation it acts as an effective heat shield for the panel, protecting the panel against radiated heat directed at the coating, which otherwise can cause excessive moisture loss from and distortion of the panel. The adhesive also becomes softened to an effective extent substantially faster than an adhesive that does not contain such a heat absorptive agent and reduces the time during which heat must be applied to the film 14 and adhesive 28 in the fabrication of a skin package by a substantial amount, i.e., twenty to thirty percent, while attaining at least an equal degree of adhesion between the film and supporting panel. This reduction in heating time not only increases the production rate, but also has the important advantage of keeping the film 14 cooler (yet adequately softened or tacky) and therefore stronger.

As illustrated in FIG. 2, the film 14 is adhered only to the central section 12*y* of the supporting panel. It will be appreciated, of course, that the invention can also be embodied in a package in which the supporting panel is merely a conventional card adapted to be completely covered with the film. In the preferred embodiment shown, the film extends beyond the central section 12*y* to form a free border or marginal portion 14*a,* 14*b* on two sides of the supporting panel section 12*y.* These border or marginal portions are formed because the film 14 extends beyond the edges of the panel section 12*y* when the panel 12 is folded to the configuration shown in FIG. 1, at the time the film 14 is applied. This particular border arrangement is a peculiarity of the manufacturing operation and it is not necessary that a border portion be provided. On the other hand, a border portion along the edge at which the tear element exists from the underlying board is advantageous, because it facilitates grasping the film after the film has been severed, to open the package. It is also difficult to trim the bordering film without severing the extending portion of the tear element. In making the particular package shown, four packages are formed at once, with four panels arranged in a generally square configuration, each contiguous with two others along two sides. One large sheet of plastic film is placed over the four panels, which are each folded in the manner shown in FIG. 1, and two parallel tear elements are extended, each across two panels beneath the film. A vacuum is then drawn to pull the sheet over the individual articles and against the individual panels. The sheet or film extends beyond the edges of the composite panel arrangement on all four sides, but is then severed along with the tear elements to separate the individual panels, resulting in individual packages with border or marginal portions on the two outside edges, one of which includes an extending portion of the tear element 16. Polyethylene film is particularly suitable as a covering film 14 and where substantial strength is desired, a film thickness of 10 mils is used.

The tear element 16, as shown in FIGS. 1 and 2, extends across the panel section 12*y* and beyond one edge 30 to provide an extending end 16*a* to which a pull tab 31 is attached. The tear element 16 extends across the upper surface of the panel 12 and across the article A, and lies beneath the film 14, being anchored, i.e., secured, against the panel on opposite sides of the article A by the film, but is not bonded to the film or to the panel. The combination of the frictional resistance and the contoured path that the element follows over the packaged article prevents the remote end from pulling loose when one end is pulled to open the package. The tear element is readily stretchable, i.e., capable of being substantially elongated without breaking, and retains substantial strength when stretched to its maximum extent. An elastic element readily stretchable at room temperature to a substantial extent, for example, to twice its unstretched length, has so far proved to be the most desirable tear element and provides the above characteristics. Being elastic, it will initially stretch a small amount under a very small force so that it will readily deform to the extent necessary to substantially follow the contour of the article over which it extends, when the film 14 is drawn over the article and against the panel, and will subsequently stretch a very substantial amount when pulled to open the package and effectively slice its way through the covering film in a manner described in more detail subsequently. Thus, in the finished package, the element 16 is initially in a slightly stretched condition within the package, i.e., beneath the film 14. Because the tear element closely follows the contour of the packaged article, it is held or anchored in place by the film and the article contour and will not pull out of the package during opening until the film is torn at least partially across the packaged article. Notwithstanding the ability of the tear element to readily stretch during the package forming operation, slight ribs or fillets 32 remain adjacent the base of the article, but extend only a slight distance laterally and are sufficiently small that the film 14 does not usually come together beneath the tear element at the fillet or, if it does, the extent is too minor to hinder the ability of the tear element to open the package.

The advantage of the ability of the tear element to readily stretch during the package forming operation, slight ribs or fillets 32 remain adjacent the base of the article, but extend only a slight distance laterally and are sufficiently small that the film 14 does not usually come together beneath the tear element at the fillet or, if it does, the extent is too minor to hinder the ability of the tear element to open the package.

The advantage of the ability of the tear element is readily stretch under the force of the film will be especially appreciated when it is understood that in the typical package forming operation, it is most convenient if opposite ends of the tear element 16 are clamped within a frame or otherwise firmly held, along with the film 14. The ability of the film 14 and the tear element 16 to conform substantially to the contour of the article A depends upon the ability of each to stretch, since there is no provision for allowing slack by inward movement of the marginal or end portions. Thus, a typical non-expandable string as used as a tear element in conventional packages, would tend to make contact only across the top of the article and at opposite edges of the panel and would tend to span the distances inbetween. Not only would the appearance of such a package be unsuitable, but also the article would not be held as securely by the film and the film would tend to make contact with itself and become sealed together beneath the spanning portions of the string, rendering the string ineffective for its purpose of releasing the product when pulled through the overlying film. The stretching of the present tear element under the force exerted by the softened sheet as it is drawn down over the product substantially eliminates spanning by the element between the product and the panel, and the accompanying disadvantages.

A preferred tear element 14 is comprised of both an elastic and non-elastic material. The non-elastic material is provided on the outside of the elastic material, does not prevent stretching of the elastic material and creates a rough outside surface, especially when the elastic material is stretched. Most advantageously, the non-elastic outside material is constructed to limit the extent to which the elastic material can stretch so that the elastic material, which in the preferred embodiment is of lower tensile strength than the non-elastic material, does not break when the tear element is pulled and a substantial amount of stretching has occured. A particularly suitable tear element is a fiber covered elastic strand and it has been found that a relatively weak strand, for example a strand that will break when subjected to a pull of about two pounds, is satisfactory for opening packages made with polyethylene film up to 10 mils of thickness, because of its effectiveness in tearing the film with a relatively low pulling force. A tear element of this type is shown in FIG. 6, and comprises an elastic rubber core 34, a double strand thread 36 of material such as nylon or cotton (preferably nylon) helically wound about the rubber core, and a cover wrapping 38 of a material such as nylon or cotton (preferably nylon) helically wound in an opposite direction about the thread 32. Nylon is preferred because it will melt along with the elastic core upon the application of localized heat and therefore can be readily severed along with the film during package forming by a so-called hot wire, i.e., a narrow, heated element, often used in skin packaging machines to sever or cut the thermoplastic film. An example of such a device is disclosed in the copending application of Ridley Watts, Jr., Ser. No. 869,420, filed Aug. 15, 1969,/ (now U.S. Pat. No. 3,614,383 entitled "Impulse Heating Device For Use With Thermoplastic Materials", and assigned to the assignee of this application. Although the thread 32 and cover wrapping 34 have very little inherent stretch, they permit substantial stretching of the rubber core by virtue of their helically wound orientation. When the tear element is stretched, it will readily expand to within two to three times its original length, at the same time becoming thinner. As the windings or convolutions of the covering theads become spaced during the stretching, they create a rough, tooth-like, surface on the tear element, which then has a sawing or abrasive effect upon the film 14 as it is pulled.

The manner in which the package of FIGS. 1 and 2 is opened, is best shown in FIG. 3. The pull tab 31 of the tear element 16 is grasped and the tear element is pulled in a direction away from the panel 12 and also back along its length. Because of the border or marginal portion **14*b*, the tear element must initially sever a double thickness of film. With 10 mil thick polyethylene film, this would be extremely difficult using an ordinary piece of twine, yet is easily accomplished with the tear element of the present invention. As the extending end 16*a* of the tear element is pulled, the element stretches, including that portion of the element between the edge 30 and the article A. As a result of this stretching, the tear element is moving relative to the film 14** so that a slicing or sawing action is achieved at the point where it exits from beneath the film, where it is applying pressure. This movement coupled with the roughness of the element surface and the reduced diameter, causes the element to quickly and easily cut its way through the film, even the double thickness, and sever the film across the article, as shown in FIG. 3. The two portions of the border or margin 14*b*, on opposite sides of the severed line, are then grasped and pulled away from the panel and away from each other to the position shown in FIG. 3, to readily expose the article.

While it is believed that the manner of forming a package that embodies the present invention will be evident from the foregoing, the following is a brief description of the preferred steps. A sheet of plastic film is drawn from a source of plastic film and clamped in a frame of a size adapted to surround a panel and product or a plurality of panels on which products are supported. Preferably the source of plastic sheet is a roll. A tear element is drawn from a source, such as a spool or the like, and is extended directly beneath the film and clamped in the frame. Advantageously, both the film and the tear element are drawn simultaneously from their sources to the frame and clamped. If plural panels are to be used in forming a plurality of packages simultaneously — for example, if four panels are to be arranged in a square each contiguous on two sides with another — two tear elements are drawn along with a sufficiently large portion of plastic film, each tear element extending across two panels aligned in the direction in which the tear element extends. The tear element or elements are maintained under enough tension to hold them taut but substantially unstretched. The frame, along with the secured film and tear element or elements, is positioned above a vacuum platen and beneath a radiant heater. One or more panels with an adhesive coating facing upward are placed on the vacuum platen and one or more articles are placed on each panel. This may be done before or after the film is drawn and clamped in the frame, but in the preferred process, the film is drawn into the frame as the previously formed package is removed and therefore the articles and panels are placed in position after the film has been clamped and raised to a position above the platen. Radiant heat is then directed at the film and panel from above the film. Substantial heating of the film occurs convectively from ambient air heated by the elements of the radiant source. When the film and coating have softened, the frame is lowered and a vacuum is drawn beneath the film, forming the film and tear element or elements over the article or articles and adhering the film to the panel, or panels. The film is then released from the clamping means on the frame, the panel or panels and film are moved from the platen and the film and tear element or elements are severed from the sources. In a preferred operation, both the tear element or elements and the film are severed concurrently by the application of localized heat, as by a heated wire, brought into contact with the film and tear element or elements adjacent one edge of the clamping frame.

A comparative test, utilizing a stretchable tear element as described above and cotton string of substantially the same diameter in a package as shown in FIGS. 1 and 2, with a covering film of polyethylene 10 mils (0.010 inch) thick, shows that the string requires approximately eight times the pulling force required by the elastic tear element to sever the 10 mil thickness of the film.

As a first example, a package as shown in FIGS. 1 and 2 was made with a corrugated cardboard panel, SURLYN D adhesive coating, a cotton tear string approximately 0.02 inch in diameter and polyethylene film of a nominal 10 mil thickness. The film and string were supported above the cardboard base, clamped in a vertically movable frame of a mechanism substantially corresponding to that shown in said application, Ser. No. 668,372 now U.S. Pat. No. 3,501,886. The film and adhesive coating were heated, the frame was then lowered to bring the film and string into contact with the cardboard panel and a supported article, and a vacuum was drawn beneath the film to form it over the article and adhere it to the panel. The string failed to conform closely to the contour of the article and portions of the film on opposite sides of the string became adhered to another beneath the string. The string was started through the film to eliminate the need to sever a double thickness. A spring scale was then attached to the free end of the string and the string was pulled by a force applied to the scale. The reading of the scale varied somewhat as the string severed the film. The approximate average force observed on the spring scale was six pounds. Even though the string severed the film the article was not easily removed because the film remained sealed beneath the severed portion over much of the width of the package.

As a second example, a package as shown in FIGS. 1 and 2 was made identically to that described in connection with the first example above, except that an elastic tear element of approximately the same diameter as the string referred to in the first example was utilized, said tear element being comprised of a rubber core, a double strand cotton thread covering helically wound about the rubber core and a cotton thread covering helically wound about the rubber core and a cotton cover wrapping helically wound in an opposite direction about the thread. The tear element was held under sufficient tension during the forming of the package to keep it substantially straight across the supporting frame prior to being lowered onto the product with the film, but was essentially unstretched. In the finished package, the tear element conformed substantially to the shape of the article on the base panel and there were essentially no areas in which the film became sealed together beneath a span of the tear element. The tear string was started through the 10 mil thick film to an initial extent to where it was beyond any double thickness of the covering film and was then connected to the same spring scale and pulled by a force applied to the scale. The approximate force observed on the spring scale as the film was severed was $\frac{3}{4}$ of a pound. The film was completely severed along the tear element and the article was easily removed.

As a third example, a package was made as described in the first example. A marginal edge of the 10 mil thick film was folded back upon itself along the edge of the package from which the free end of the string extended. The string was pulled with the spring scale. The scale registered 25 pounds but the string had not cut through the double thickness of film. Rather, the string tended to stretch, bunch and wrinkle the film at the exit point of the string where the string applied force to the film.

As a fourth example, a package was made as described in the second example. A marginal edge of the 10 mil thick film was folded back upon itself along the edge of the package from which the free end of the elastic tear element extended. The tear element was pulled with the spring scale and the string severed the double thickness. The force observed on the spring scale as the double thickness was severed was $1\frac{1}{4}$ pounds.

A modified embodiment of a package embodying the present invention is shown in FIG. 4, in which a plurality of articles are packaged for independent removal. A panel 12' is provided, of identical construction to the panel 12 of FIGS. 1 and 2. Two articles A' and A" are supported on a central section of the panel and are covered by a film 14' of identical construction to the film 14 of the embodiment of FIGS. 1 and 2. Two separate tear elements 16' and 16" are provided, each independently associated with one of the articles A' and A", extending across the center section of the panel 12" and across the respective article. Ends **16*a*' and 16*a*" extend beyond an edge of the overlying film 14'. As shown in FIG. 4, the tear elements extend across the cut line 18 and are thus oriented at 90 degrees to the orientation of the tear element 16 of FIGS. 1 and 2. This is merely to illustrate that the particular orientation of the tear element is not critical. Each tear element is utilized independently of the other in the same manner as described in connection with the tear element 16 and either article A may be removed independently of the other. The other article will remain packaged, covered and protected by the film 14'**. In the event it is known at the time of packaging that the two articles will be removed at the same time, as when they must be used together, a single tear element can be provided, which extends across both articles.

For purposes of illustrating the manner in which the stretchable tear element can serve to create a rigidifying rib with articles of certain configurations, the article A" is cylindrical, rests on its side on the supporting panel 12', and the tear element 16" extends across the longitudinal axis of the article. While the tear element substantially conforms to the underlying shape of the article, it has resisted being drawn underneath the article as the film is formed. As a result, the film 14' is not drawn under the article at the location of the tear element and a reinforcing rib 40 is formed in the film on each side of the article and acts as a buttress to prevent the cylindrical article from tending to roll or wobble about the tangent line with the supporting panel. At the same time, the portion of the tear element that spans the distance between the article and the panel is sufficiently short that in most instances the film will not contact itself beneath the tear element or, in those instances where it does, the extent is so slight that it does not significantly hamper the opening of the package.

The term "tear element" as used herein has been adopted because known strands or the like for opening packages have typically been called "tear strings" or "tear strips", apparently because they rupture or "tear" through a covering sheet. The term "tear element" as used herein is intended to encompass elements that sever or part a covering material by an action thereagainst, which action may in fact be a cutting, sawing, abrading or rupturing action, or the like.

From the above description it will be appreciated that a new and improved package utilizing a novel tear element has been provided, that a novel skin package with a tear element has been provided, and that a novel skin package with an improved adhesive and improved panel construction has been provided. It will also be appreciated, that while preferred embodiments have been described in detail, modifications or alterations may be made therein without departing from the spirit and scope of the invention set forth in the appended claims.

What is claimed is:

1. A package comprising a panel scored to form three side-by-side sections with the two end sections foldable beneath the center section, a packaged article, a plastic film over said article and adhered only to the surface of the center one of the three sections and drawn substantially around the article, and a tear element extending beneath the film, over the article, across the panel, and secured to the package on opposite sides of the article by the film, with one end extending from between the panel and film, said panel being shaped and scored to facilitate its being folded to form a box that surrounds said film and packaged article.

2. A package as set forth in claim 1 wherein the center section of said panel includes a thermoplastic adhesive coating containing a substance substantially opaque to infrared radiation.

3. A package as set forth in claim 2 wherein said tear element is elastic, has surface irregularities along its length when stretched, and is partially stretched beneath the film and substantially follows the contour of the article.

4. A package as set forth in claim 1 wherein said tear element is elastic and capable of being stretched to at least twice its unstretched length without breaking.

5. A package as set forth in claim 4 wherein said tear element has surface irregularities along its length when stretched.

6. A package as set forth in claim 1 wherein said tear element is elastic, is partially stretched beneath the film and substantially follows the contour of the article.

* * * * *